United States Patent [19]

Lehnhardt

[11] 4,379,213

[45] Apr. 5, 1983

[54] ELECTROACOUSTICAL CONVERTER

[75] Inventor: Lutz Lehnhardt, Berlin, Fed. Rep. of Germany

[73] Assignee: BM-Elektronik Meletzky KG, Berlin, Fed. Rep. of Germany

[21] Appl. No.: 209,115

[22] Filed: Nov. 21, 1980

[30] Foreign Application Priority Data

Nov. 21, 1979 [DE] Fed. Rep. of Germany ..... 2946981

[51] Int. Cl.[3] ..... H04R 7/14; H04R 9/06

[52] U.S. Cl. ..... 179/115.5 R; 179/181 R; 181/157; 181/160; 181/173; 181/199

[58] Field of Search ..... 181/144, 148, 153, 155, 181/157–175, 191, 196; 179/1 F, 146 E, 181 R

[56] References Cited

U.S. PATENT DOCUMENTS

| | | | |
|---|---|---|---|
| 1,690,726 | 11/1928 | Holinger | 181/173 X |
| 3,424,873 | 1/1969 | Walsh | 181/166 X |
| 3,826,333 | 7/1974 | Buckwalter | 181/155 X |
| 4,064,966 | 12/1977 | Burton | 181/155 X |

FOREIGN PATENT DOCUMENTS

| | | |
|---|---|---|
| 905378 | 1/1954 | Fed. Rep. of Germany . |
| 2709374 | 9/1978 | Fed. Rep. of Germany . |
| 862867 | 3/1941 | France . |

*Primary Examiner*—Benjamin R. Fuller

*Attorney, Agent, or Firm*—Cushman, Darby & Cushman

[57] ABSTRACT

A barrel-shaped diaphragm comprising a plurality of barrel stave-like strips with slits forming gaps between them is mounted on the vibration coil of a vibration generator that is based on a housing. A traverse bar which is based on the housing extends up through the center of the diaphragm. A sound conducting member that is cylindrical at the bottom and domed at the top is disposed on the vibration generator, within the diaphragm, and provides a gap of increasing cross-sectional area expanding toward the open upper end of the diaphragm. An inverted pot-shaped top is mounted on the upper end of the diaphragm. This top has an upper end wall with a depending sidewall that tapers in conically near the lower end. A plurality of struts extend obliquely from the tapered portion to the traverse rod to connect the lower end of the top, and thus the upper end of the diaphragm to the rod, and thus to the housing of the fibration generator. In one embodiment the top is filled with sound-damping material; in another a coaxial pipe is provided as a baffle, and sound outlet holes are provided in the top near the lower end. The diaphragm may be made of a single strip that is bent into an annulus. The diaphragm may be coated with sound damping material.

11 Claims, 9 Drawing Figures

ELECTROACOUSTICAL CONVERTER

Such an electro-acoustic converter is known, for example, from the French Pat. No. 862 867. The diaphragm member of this known loudspeaker is of generally ellipsoidal shape and is provided on the inside with a damper, which is adapted to the shape of the diaphragm body and is provided with apertures through which air may pass, but is braked because of the small size of the apertures in consequence of the flow resistance upon passage. The sound waves not hitting the apertures, however, may be reflected from this damper and enter into a disturbing reciprocal action with the inside surface of the diaphragm member.

Furthermore, an electro-acoustic converter is known from German Pat. No. 2 709 374, which has one or several barrel-shaped diaphragm members. The wall of this diaphragm member consists of two or more layers, which are formed from materials of variable hardness. Inside the diaphragm member, damping material is attached which however enters in reciprocal mechanical action with the diaphragm and thus has an unfavorable influence on its vibration.

An object of the present invention is to allow the sound waves radiated from the inside surface of such a diaphragm member to exit through a free opening upwards, so that they may either be dampened or used as a desired signal in addition to sound waves radiated from the outside surface.

In practicing the present invention a sound conductor is attached inside the diaphragm member, which sound conductor deflects the sound waves radiated from the inside surface of the diaphragm member upwards and conducts them out of the inside space. A reciprocal action of these sound waves with the diaphragm member is therefore not to be feared any longer, since these sound waves are conducted out of the diaphragm member.

Such a sound-conducting body may consist of a spherical body which is attached in the lower part of the diaphragm member, so that a gap is formed between the sound conductor and the inside surface of the diaphragm member, which expands from below to the top, so that the sound waves entering this annular gap space are deflected upwards and finally may exit by the upper opening of the diaphragm member.

According to a preferred embodiment of the invention, this sound conductor is shaped generically spherically in its upper portion and generally cylindrically in its lower portion. The sound conductor is firmly connected with the housing of the vibration generator, and the bar effectively passes through said sound conductor, which connects the upper edge of the diaphragm member rigidly with the housing of the vibration housing.

In a preferred embodiment that is considered to be particularly advantageous, a pot-shaped top follows the diaphragm member upwards. The pot-shaped top is in an inverted condition, so that its end wall is uppermost and its sidewall extends downwards and is connected by way of a cross-tie, for example, and a rigid rod, with the housing of the vibration generator. The lower end of this pot-shaped top is provided by a downwardly tapering generally conical sidewall portion, which has a central aperture. The edge of the central aperture is connected with the upper edge of the diaphragm member and the sound waves enter into the pot-shaped top through this aperture.

The inside of this top ma be filled with sound damping material, whenever one does not wish to use the sound waves emerging from the inner space of the diaphragm member upwards as an intelligence signal. As an alternative, in this inside space, a pipe may be attached which surrounds the central bar concentrically and which below connects with the edge of the aperture of the pot-shaped top and thus simultaneously with the upper edge of the diaphragm member. This pipe leads upwards up to almost the upper end wall of the pot-shaped top and outside of this pipe sound exit apertures are provided in the tapering lower portion of the side wall. The sound emerging from the diaphragm member is guided first upwards between the pipe and the bar and then enters into the outside concentric annular chamber of the pot-shaped top, is guided from there downwards and emerges as an intelligence signal from the apertures. In this way, the sound energy radiated inward which, as a rule, is destroyed because of the phase shift, may be used as an intelligence signal and contributes to the increase of the degree of effectiveness of the electro-acoustic converter.

The diaphragm itself may consist of a sheet which is shaped in the corresponding manner into a barrel-shaped form. In order to make the bending more easy, a series of longitudinal slits is formed in the sheet so as to proceed along the sheet effectively in the direction of the curvature. These slits then open up during bending of the sheet into the barrel-shaped form and thus permit a corresponding deformation.

In order to define the deformation, it is also possible to dispose beads in the sheet, these beads running in parallel to the slits. The beads oppose the resistance to bending, which resistance however may be defined precisely by the shape of the beads.

In order to separate the inside space from the outside space of the diaphragm member, these slits are effectively bridged with a foil or film, whereby said foil or film may consist, for example, of silicon rubber.

BRIEF DESCRIPTION OF THE DRAWING

An embodiment of the invention will be shown by way of example and explained on the basis of the drawing, in which.

DETAILED DESCRIPTION

Figure 1:
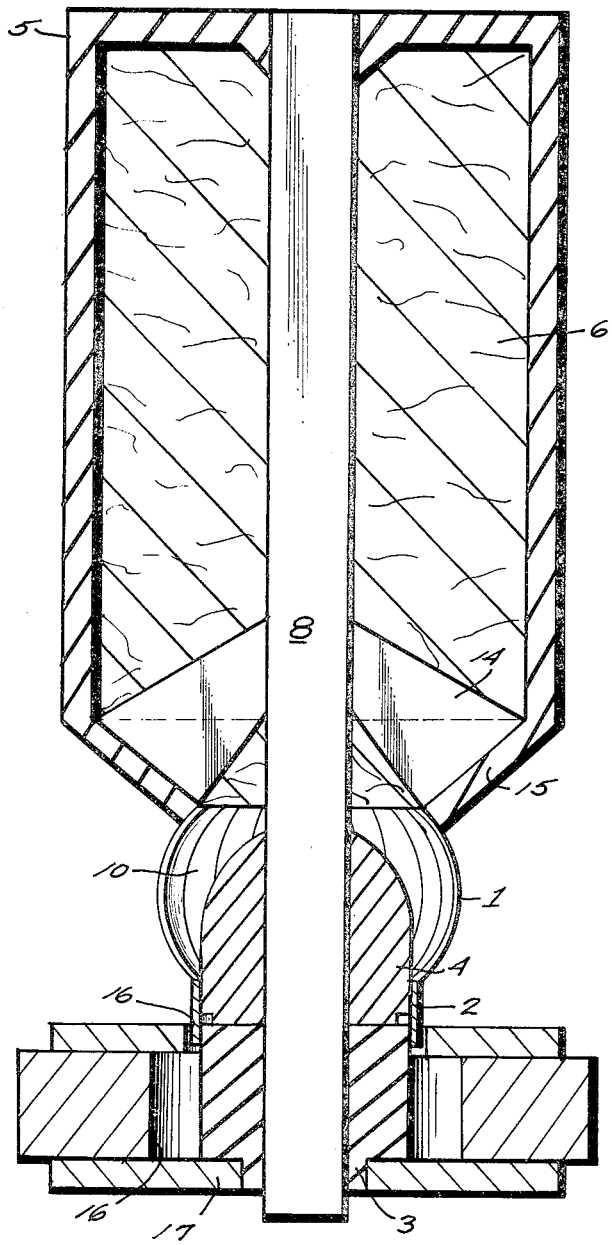
FIG. 1 is a longitudinal sectional view of a first embodiment of an electro-acoustic converter provided in accordance with principles of the present invention.
Figure 2:
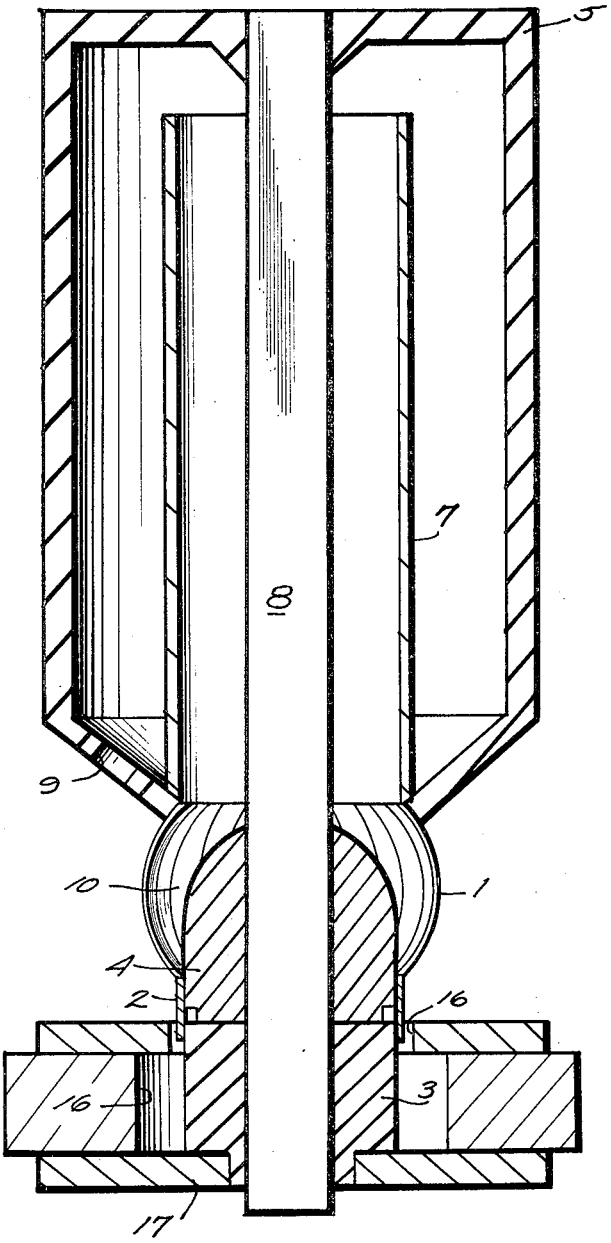
FIG. 2 is a similar longitudinal sectional view of a second embodiment thereof.

It is clear from FIG. 1, that the diaphragm member 1 is connected at its lower end with a vibration coil 2 which immerses into the annular gap of a magnet 3. The annular gap 16 is shown formed between the magnet 3 and the vibration generator housing or base 17 on and in which the magnet 3 is disposed. In the inside of the diaphragm member 1, a sound conducting member 4 is shown, which is struck by sound waves radiated from the inside surface of the diaphragm member and are deflected upwards. The upper edge of the diaphragm member 1 is connected with a pot-shaped top 5, which, as shown, may be filled entirely with sound damping material 6. In the case of this embodiment, the sound entering into the pot-shaped top is destroyed by damping. FIG. 2 shows a different embodiment in which, instead of a filling of sound damping material, the interior space of the pot-shaped top is provided with a pipe 7 which is disposed in the inside concentrically so that it spacedly envelops the traverse element 8 which is shown developed as a bar and leaves a path for the sound waves open between the traverse and the pipe, so that the sound waves may move from the inside of the diaphragm member, upwards. The pipe 7 terminates at a certain distance below the underside of the upper end wall of the pot-shaped top 5, so that the sound waves may enter along the underside of that upper end wall and into the outside space of the pot-shaped top i.e. to radially outside the pipe 7, from where they are guided downwards and emerge into the outside through sound exit apertures 9. As a result of the running time through which the sound waves pass in this pot-shaped top, the phase shift between the sound waves radiating from the diaphragm member to the outside and inside are neutralized for a certain frequency range or they are reduced in such a way that the sound waves emerging from the apertures 9 may be delivered as an intelligence signal to the surroundings.

Figure 3:
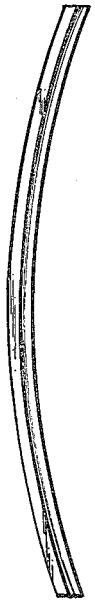
FIG. 3 is a side elevational view of one element of the barrel-shaped diaphragm for either embodiment, in a first variation wherein the barrel-shaped diaphragm is assembled from a plurality of such individual elements.
Figure 5:
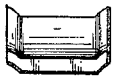
FIG. 5 is a top plan view of the diaphragm element of FIGS. 3 and 4.
Figure 4:
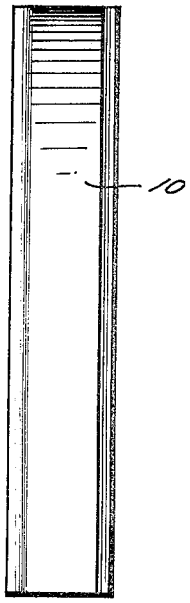
FIG. 4 is a front elevational view of the diaphragm element of FIG. 3.
Figure 6:
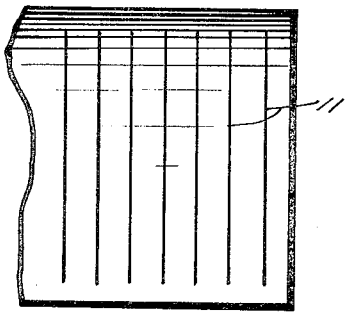
FIG. 6 is a fragmentary front elevational view of a slit strip which may be wrapped around in a ring to form a second variation of the barrel-shaped diaphragm.
Figure 7:
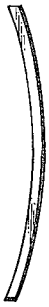
FIG. 7 is an end elevational view thereof.

FIGS. 3, 4 and 5 show an individual element or segment 10 of a first variation the diaphragm member 1 in three different views. One can see how such a segment is bent, and may be assembled together with like segments so that an approximately barrel-shaped body results altogether. FIGS. 6 and 7 show a strip of sheet metal which is provided with slits 11 which make it easier so that the curvature of the sheet metal, to form the second variation of the diaphragm, which curvature is shown in FIG. 7, may be executed.

Figure 8:
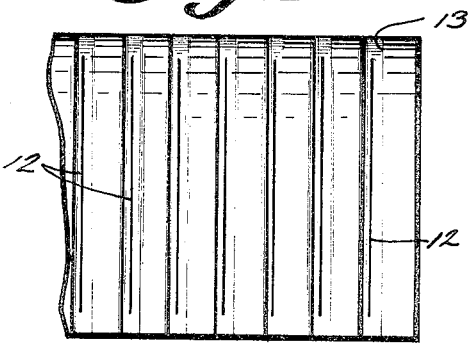
FIG. 8 is a fragmentary front elevational view similar to FIG. 6, but of a third variation, wherein the slit strip is provided with beads and grooves running along beside the respective slits.
Figure 9:
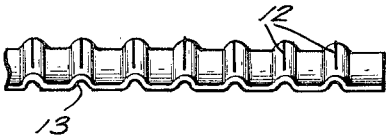
FIG. 9 is a top plan view thereof.

In FIGS. 8 and 9, a third variation is shown wherein in addition to the slits 12 grooves 13 may be provided in the sheet metal which strip is to be bent around into an annulus to form the barrel-shaped diaphram. The grooves 13, which appear as beads on the opposite side of the sheet, ensure a definite resistance to deformation.

In order to avoid resonance vibrations, the metal strips of the diaphragm member are covered on the inner and/or outer surface with a thin rubber layer, which gives a high damping effect in connection with a low additional mass. The metal strips are painted with a rubber solution having a high content of solvent, whereupon a homogenous thin rubber layer remains after drying, which will avoid resonance in an effective way. The rubber solution may be constituted of silicon rubber and, in any event, may be so applied as to leave a foil or film of rubber extending across the gaps which open up at the sites of the slits as the slit strips are bent around to barrel-shaped form.

In order to avoid resonance vibrations on the pot-shaped top 5 on which the diaphragm is directly fastened, said top 5 is supported near the diaphragm 1 by radial struts 14 extending to the traverse 8, so that no resonance vibration will occur any more on the pot-shaped top 5, especially on its upper end wall portion. For example, four sheet metal struts distributed over the circumference are fastened on the lower frustum-shaped section 15 of the pot-shaped top 5 in such a way that the axis of the traverse 8 lies, say, in the plane of these sheet metal struts. For obtaining sufficient stiffness, the sheet metal struts show a width dimension corresponding to approximately the length of the frustum-shaped section 15 of the top, and they obliquely extend upwards from this, whereby they are attached to the traverse 8.

The support of the top 5 by means of radial struts on its lower section is also advantageous for centering the vibration coil 2 attached to the diaphragm in the annular gap of the magnet 3.

The electro-acoustic converter, described here, is suitable particularly for the treble range and has the advantage of a better degree of effectiveness as against comparable converters.

I claim:

1. An electro-acoustic converter, comprising:

a vibration generator having an annular vibration coil;

means at least partially housing said vibration generator and providing a gap out through which said vibration coil projects;

a barrel-shaped diaphragm member comprising a plurality of pre-bent arcuate strip means arranged in a ring so as to be convex outwards and so as to have two opposite annular ends;

the vibration generator being disposed at one end of the barrel-shaped diaphragm with the vibration coil thereof connected to said one end of said diaphragm;

a traverse bar mounted to said vibration generator housing means and extending longitudinally centrally through said vibration generator;

means connecting the opposite end of the diaphragm with the traverse bar; and a sound-conducting member spacedly disposed internally of the diaphragm and based in the vicinity of said one end of said diaphragm, the diaphragm and sound-conducting member being so shaped and positioned relative to one another so as to leave an annular gap therebetween, which gap expands in cross-sectional area from said one end toward said opposite end of said diaphragm, so that sound waves radiated internally from said diaphragm are conducted towards said opposite end of said diaphragm.

2. The electro-acoustic converter of claim 1, wherein:

said sound-conducting member has a cylindrically curved sidewall portion disposed nearest said one end of said diaphragm, surmounted by a hemispherically curved dome portion disposed nearest said opposite end of said diaphragm.

3. The electro-acoustic converter of claim 1 or claim 2, further including:

an inverted pot-shaped top having an end wall and a generally tubular sidewall having a base end located distally of said end wall;

means connecting the base end of the sidewall of said inverted pot-shaped top to said opposite end of said diaphragm member; and said traverse bar connecting said end wall of said inverted pot-shaped top with said vibration generator housing means.

4. The electro-acoustic converter of claim 3, further including:

a body of sound-damping material filling said inverted pot-shaped top.

5. The electro-acoustic converter of claim 3, further including:

a sound-conducting tube coaxially received within said inverted pot-shaped top;

means mounting said sound-conducting tube at one end thereof to said sidewall of said inverted pot-shaped top adjacent said base end of said sidewall, so that said sound-conducting tube axially beyond said one end is radially spaced from said sidewall to provide an annular gap;

said sound-conducting tube ending short of said end wall of said inverted pot-shaped top; and means providing a plurality of sound outlet openings through said sidewall of said inverted pot-shaped top, outside of said sound-conducting tube, near said base end of said sidewall of said inverted pot-shaped top.

6. The electro-acoustic converter of claim 3, wherein:

said diaphragm comprises a curved metal strip formed into an annulus and having a plurality of longitudinal slits disposed in a series which proceeds circumferentially of the annulus.

7. The electro-acoustic converter of claim 6, further including:

means providing a plurality of bead and groove forms on said strip, each bead and groove form being located beside a respective slit and appearing as a bead on one face of the strip and as a groove on the opposite face thereof.

8. The electro-acoustic converter of claim 6, further including:

a bridging film of elastic material closing each of said slits.

9. The electro-acoustic converter of claim 8, wherein:

said bridging film is constituted by a film of silicon rubber.

10. The electro-acoustic converter of claim 6, further including:

a thin damping layer of rubber coating at least one face of said strip.

11. The electro-acoustic converter of claim 3, wherein:

the means connecting the base end of the sidewall of said inverted pot-shaped top to said opposite end of said diaphragm member is constituted by a plurality of angularly-spaced, radially-extending struts.

* * * * *